United States Patent [19]

Fox

[11] Patent Number: 4,991,912

[45] Date of Patent: Feb. 12, 1991

[54] REFUSE STORAGE BIN

[75] Inventor: Anthony Fox, Bloomington, Minn.

[73] Assignee: Marcella M. Fox, Bloomington, Minn.

[21] Appl. No.: 495,627

[22] Filed: Mar. 19, 1990

[51] Int. Cl.[5] ..... A47B 77/08

[52] U.S. Cl. ..... 312/236; 312/282; 312/287

[58] Field of Search ..... 312/236, 282, 287, 289, 312/269, 321.5; 198/860

[56] References Cited

U.S. PATENT DOCUMENTS

| | | | |
|---|---|---|---|
| 484,121 | 10/1892 | Stein | 312/311 X |
| 2,964,609 | 12/1960 | Anoff | 312/236 X |
| 4,026,351 | 5/1977 | Biava | 312/236 X |
| 4,086,783 | 5/1978 | Wagner et al. | 312/236 X |
| 4,123,130 | 10/1978 | Locke | 312/236 X |
| 4,455,924 | 6/1984 | Wenzel | 312/236 X |

*Primary Examiner*—Joseph Falk

*Attorney, Agent, or Firm*—Haugen and Nikolai

[57] ABSTRACT

An elongated, horizontally disposed cabinet of rectangular cross-section is mounted on wheels and is designed to store boxes or bags of compacted organic or inorganic refuse until they can be picked up by a trash hauler. To avoid the necessity of lifting the boxed or bagged-compacted trash, the cabinet includes a conveyor mechanism for facilitating the transport of such boxes or bags from the cabinet entrance to or towards its discharge end. The cabinet includes doors at each end thereof which, when closed, effectively seal the loaded refuse within the cabinet. To slow the decomposition process of the organic refuse, the cabinet is equipped with a temperature control including refrigeration means to be used when ambient temperature is above a predetermined temperature and heating means for prevent freezing when the ambient temperature is below freezing temperatures.

7 Claims, 2 Drawing Sheets

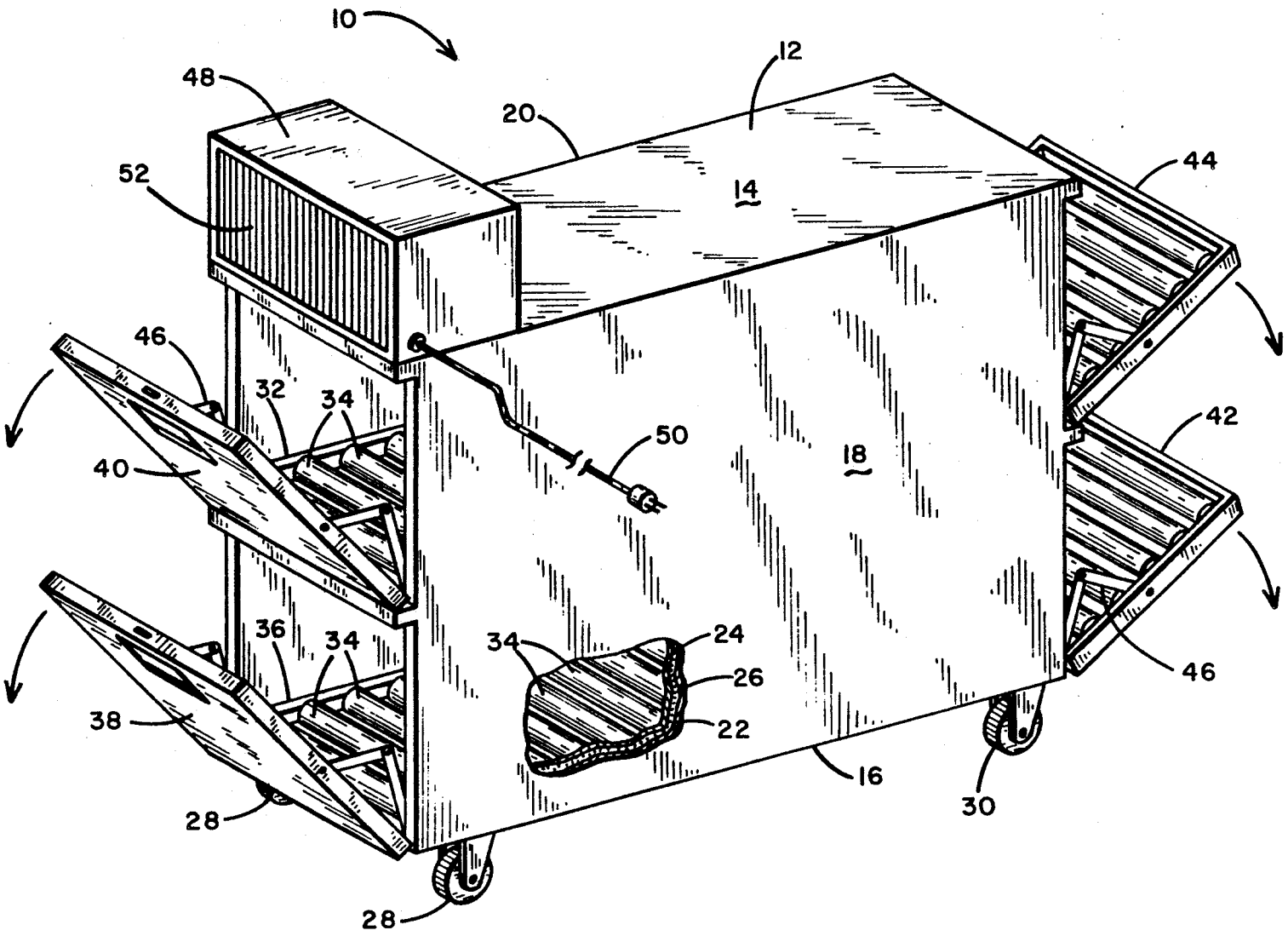
10
12
14
16
18
20
22
24
26
28
28
30
32
34
34
34
36
38
40
42
44
46
46
48
50
52

REFUSE STORAGE BIN

BACKGROUND OF THE INVENTION

I. Field of the Invention

This invention relates generally to refuse handling apparatus, and more particularly to a device for storing containers filled with compacted refuse until those containers can be picked up by a commercial hauler for ultimate disposal.

II. Discussion of the Prior Art

Many businesses generate refuse that must be picked up by a commercial hauler and taken to a landfill or incinerator for disposal. In that charges for this service are generally based on fixed volumes, such as a dumpster load, it is advantageous for the business proprietor to store refuse until that volume is filled. In those cases where the refuse includes organic matter, the practice of throwing that refuse loosely into a dumpster parked behind the building creates a significant health problem when it is considered that it may take a week or more to fill the dumpster to the point where the hauler should be called to pick up the load. The widely used dumpster generally includes an open top which allows flies, cockroaches and other insects as well as vermin such as rats and mice easy access to the decaying organic matter. That, coupled with the noxious odors given off by decaying organic refuse makes this conventional mode of trash handling and hauling most unsatisfactory.

More and more businesses have gone to refuse compacting equipment in order to reduce the volume of refuse to be disposed of. Such compactors of the type manufactured and sold by the TFC Corporation of Minneapolis, Minn., applicant's assignee, are capable of achieving a 20:1 reduction in volume by using a hydraulic ram to crush and condense garbage, bottles, cans and paper products into a cube contained within a box or plastic film bag.

In that the density of the refuse is dramatically increased, the weight of a filled bag or box may typically exceed 125 lbs. Thus, it is somewhat difficult, without an appropriate lift mechanism to deposit the compacted boxes/bags of trash into a conventional dumpster.

It will also be recognized that plastic bags and boxes containing compacted refuse do not offer a substantial barrier to rodents nor does the compaction process slow down the decomposition of organic materials. Thus, a need exists for a temporary storage system for compacted cubes of refuse until a sufficient volume is generated to warrant the calling of the commercial hauler. It is the purpose of the present invention to fulfill such a need.

SUMMARY OF THE INVENTION

In accordance with the present invention, there is provided an elongated cabinet of rectangular cross-section which is mounted on wheels for ease of movement and which includes door members at opposed ends thereof which, when closed, effectively seal the interior of the cabinet against entry by insects or other vermin. The doors are hinged about horizontal axes and when opened, are coplanar with the floor of the cabinet. Conveyor means are provided on the inner door surface and on the floor of the cabinet so that when the cabinet is wheeled up to the trash compactor, the bags or bales ejected therefrom will be deposited on the door's conveyor means and then they can be readily pushed or otherwise driven toward the discharge end of the cabinet.

In accordance with a further feature of the invention, the cabinet may be equipped with one or more shelves where each shelf also includes a conveyor means for facilitating the loading of the cabinet with filled bales/-boxes of compacted refuse.

To slow the decomposition process, the cabinet of the present invention is also equipped with a temperature control means including a refrigeration unit for maintaining the interior of the cabinet in which the refuse is stored at a low temperature, e.g., 40° F. irrespective of the outside air temperature. Moreover, to prevent freezing of the refuse when the outside temperatures fall below the freezing point, the temperature control unit includes a heating means. Both the heating means and cooling means are thermostatically controlled and powered by an appropriate alternating current supply available in the building.

DESCRIPTION OF THE DRAWINGS

The foregoing features, objects and advantages of the invention will become apparent to those skilled in the art from the following detailed description of the preferred embodiment, especially when considered in conjunction with the accompanying drawings in which like numerals in the alternative views refer to corresponding parts of a refuse storage bin in accordance with the present invention. A refuse storage bin fitted with rollers 34 as a conveyor mechanism is as shown in FIG. 1. In contrast.

DESCRIPTION OF THE PREFERRED EMBODIMENT

Figure 1:
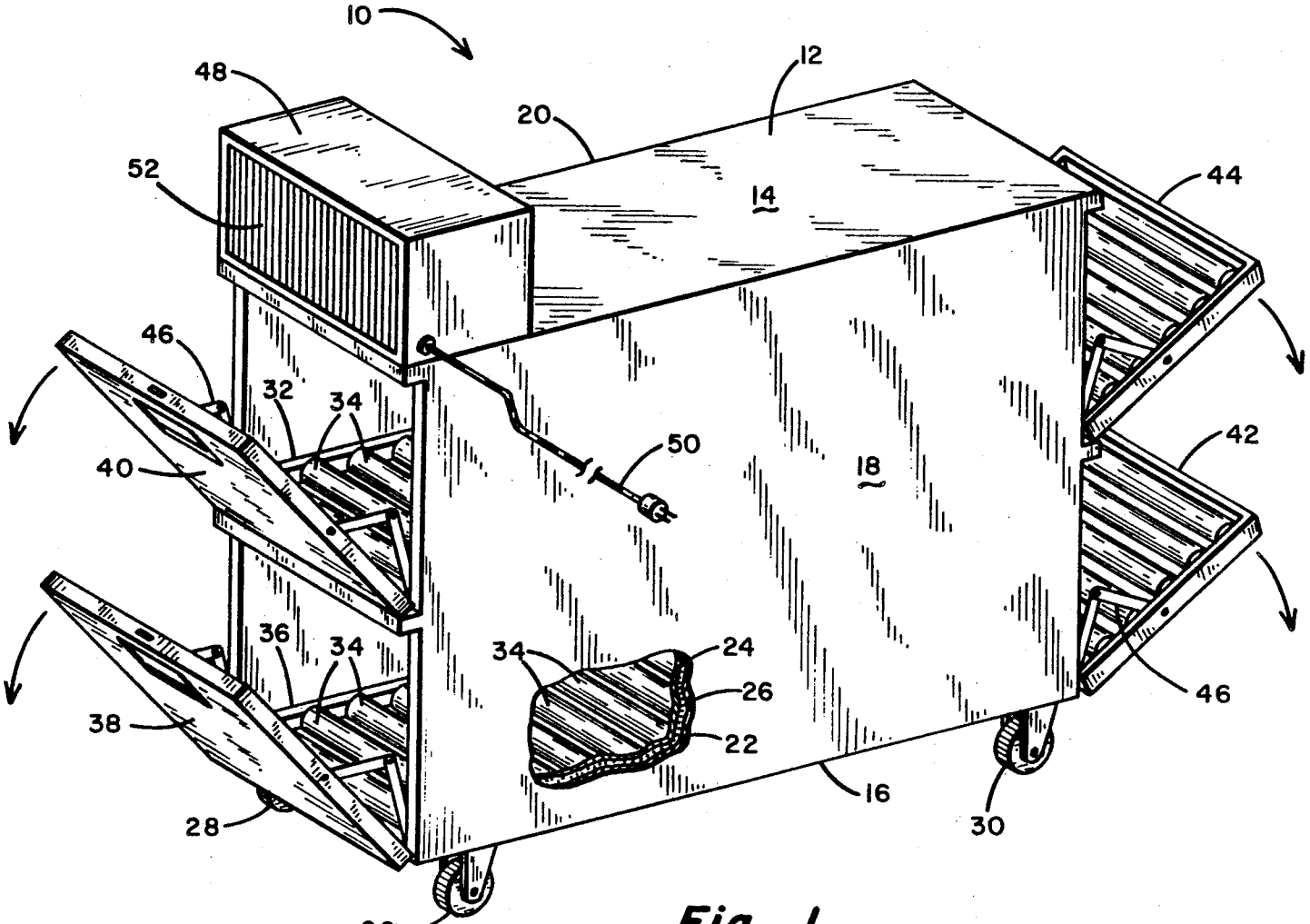

Referring to the drawing, there is indicated generally by numeral 10 a storage bin or cabinet designed to hold boxes or bags of compacted refuse until a sufficient quantity of refuse has been collected to warrant the cost of having a commercial hauler come to pick up the load for ultimate disposal. The apparatus is seen to comprise an elongated cabinet 12 having a generally rectangular cross-section defined by a top wall 14, a bottom wall 16 and opposed parallel side walls 18 and 20. With no limitation intended, and strictly for purposes of illustration, the cabinet 12 may have an overall 6 ft. 10 in., a height of 4 ft. and a width of 2 ft. 4 in. As shown in the broken away section of side 18 in the drawing, each of the walls may comprise a sandwiched construction of an outer sheet metal skin as at 22, an inner sheet metal skin as at 24 and an intermediate layer of a suitable insulating material, such as foam plastic, as at 26.

The cabinet 12 is mounted on wheels 28 and 30, the wheels 28 being fixed to the cabinet with the axis thereof transverse to the longitudinal dimension of the cabinet. Wheels 30, on the other hand, are preferably 360° swivel casters which allows the cabinet to be steered as it is pushed.

Figure 2:
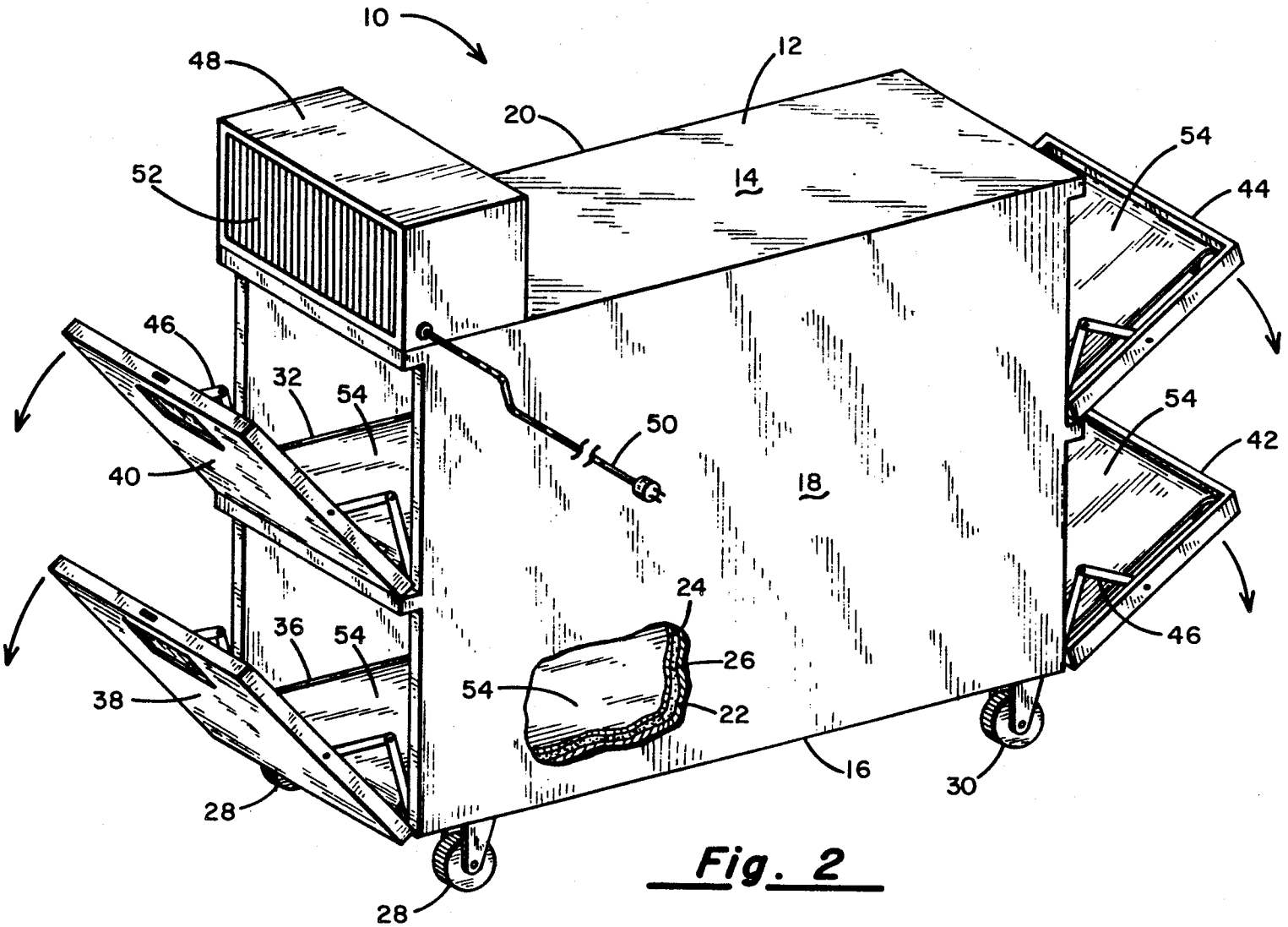
FIG. 2 shows an alternative embodiment which utilizes an endless conveyor belt 54 instead of rollers, as described hereinafter.

The cabinet 12 may, but need not necessarily include an intermediate shelf 32 such that a double tier of compacted refuse containers can be stored in the cabinet 12. Both the shelf 32 and the floor 16 of the cabinet are equipped with a conveying means, here shown as a plurality of parallel, closely spaced rollers 34 which are journaled for rotation in a bracket 36 affixed to the inner surface of the walls 18 and 20. In that roller conveyors are well known in the art, it is not deemed necessary to explain the construction thereof in detail herein. Those skilled, in the art will also appreciate that an endless belt conveyor 54 may readily be substituted for the roller conveyor in constructing the refuse storage bin, as shown in FIG. 2. Where identical components are identified, the same numbers as in FIG. 1 are used.

Hinged about horizontal axes extending along the width dimension of the cabinet and on opposed ends thereof are door members 38, 40, 42 and 44. When the doors 38 and 40 are fully open, they extend coplanar with the floor 16 and the shelf 32, respectively. In a similar manner, the doors 42 and 44 when fully open are coplanar with the floor and shelf as well. Door braces as at 46 limit the downward rotational travel of the doors to that coplanar disposition while providing sufficient strength to allow bags or boxes filled with compacted trash to be placed thereon. As can best be seen on the doors 42 and 44, they each include further conveying means in the form of plural rollers such that when the doors are open, the rollers thereon comprise an extension to the conveying means of the shelf and floor.

When the doors 38, 40, 42 and 44 are closed, the interior of the cabinet comprising the storage chamber is effectively sealed against the ingress of bugs and rodents, thus obviating the major problems associated with present-day refuse/garbage storing systems.

Mounted atop the cabinet 12 is an automatic temperature control unit 48 which is adapted to be powered via a retractable power cord 50 when plugged into the building's 110 volt AC supply. The automatic temperature control unit 48 will conventionally include condenser and evaporator coils and a refrigerant compressor arranged such that ambient air drawn in through the inlet filter 52 will be chilled before exhausting into the interior of the cabinet 12. A thermostat control (not shown) is provided for maintaining the interior at a desired predetermined temperature, e.g., about 40° F. In this way, refuse including organic matters such as garbage will not rapidly decompose to produce noxious odors.

The automatic temperature control unit 48 further includes an electrical heating element positioned relative to the blower or fan so that when the ambient temperature falls below the freezing point, the heater unit will become operational to maintain the interior of the cabinet above freezing.

Being portable, the assembly 10 can be wheeled to a location directly adjacent the refuse compactor whereby the boxed or bagged refused can conveniently be deposited onto the doors 38 and/or 40 and then pushed on the conveyors into the interior of the storage bin 12. Once filled, the cart may be pushed to a loading dock or other location where the contents may then be emptied through the exit door(s) into a trash hauling vehicle for removal to a landfill or incineration site.

An alternative embodiment wherein the conveyor means is a conveyor belt 54 on a bracket affixed to the inner surface of the walls 18 and 20 is shown in FIG. 2. Corresponding components are depicted as shown in FIG. 1, by using identical numbers in FIG. 2. As in the roller embodiment, the cabinet 12 may include an intermediate shelf 32 such that a double tier of compacted refuse containers can be stored therein. Another corollary to the roller embodiment is the affixation of conveyor belt on the inside surfaces of the doors to assist in loading and unloading heavy refuse bales. Conveyor belts are also well known in the art, so it is not deemed necessary to explain in detail the construction thereof.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. Apparatus for temporary storage of containers filled with compacted organic and inorganic waste prior to the pick-up thereof by a trash hauler comprising:

(a) a cart comprising a wheel-mounted, elongated, horizontally disposed cabinet of rectangular cross-section including a top wall, a bottom wall, two mutually perpendicular side walls and first and second opened ends defining a refuse storage chamber, said cabinet including door means at each of said open ends thereof and hinged about a horizontal axis and including conveyor means on the interior surface of said door means which, when closed, seals said open ends and said storage chamber from the ambient;

(b) conveyor means mounted in said cabinet and extending along the length dimension thereof for facilitating the filling of said chamber with a plurality of containers of compacted refuse; and (c) temperature control means mounted on said cabinet for maintaining said chamber at a predetermined temperature when said door means are closed to inhibit the decomposition of said organic waste while stored in said cabinet.

2. The apparatus as in claim 1 and further including at least one horizontal, longitudinally extending shelf mounted in said cabinet dividing said chamber into substantially equal compartments; and further conveyor means on said horizontal shelf.

3. The apparatus as in either of claims 1 or 2 wherein said conveyor means and further conveyor means each include an endless belt.

4. The apparatus as in either of claims 1 or 2 wherein said conveyor means and further conveyor means includes a plurality of closely spaced rollers journaled for rotation about axes which are transverse to the longitudinal dimension of said cabinet.

5. The apparatus as in claim 2 wherein said door means at each end of said cabinet includes a pair of independently operable door members which, when fully opened, one is coplanar with said bottom wall of said cabinet and the other is coplanar with said shelf.

6. The apparatus as in claim 1 wherein said top wall, bottom wall and side walls of said cabinet each include an inner layer and an outer layer and an intermediate layer of insulation.

7. The apparatus as in claim 1 wherein said temperature control means includes electrically operated cooling means and heating means and means for selectively activating said cooling means and heating means as a function of the temperature within said chamber.

* * * * *